US005244526A

United States Patent [19]

Johenning

[11] Patent Number: 5,244,526

[45] Date of Patent: Sep. 14, 1993

[54] METHOD AND APPARATUS FOR MANUFACTURING A WATERBED BAFFLE STRUCTURE

[75] Inventor: John B. Johenning, Beverly Hills, Calif.

[73] Assignee: Strata Flotation, Inc., Torrance, Calif.

[21] Appl. No.: 861,603

[22] Filed: Apr. 1, 1992

Related U.S. Application Data

[60] Division of Ser. No. 660,604, Feb. 22, 1991, Pat. No. 5,172,437, which is a continuation-in-part of Ser. No. 395,714, Aug. 18, 1989, Pat. No. 5,068,934.

[51] Int. Cl.[5] ..... B32B 31/20

[52] U.S. Cl. ..... 156/292; 156/297; 156/583.9

[58] Field of Search ..... 156/65, 290, 292, 297, 156/308.4, 552, 562, 204, 210, 583.6, 583.7, 583.8, 583.9; 428/116, 117, 118, 119; 5/451, 449, 450, 455, 480, 422, 457–458, 441, 914, 920–921

[56] References Cited

U.S. PATENT DOCUMENTS

| | | | |
|---|---|---|---|
| 3,753,819 | 8/1973 | Mollura | 156/69 |
| 4,218,274 | 8/1980 | Mollura | 156/65 |
| 4,574,026 | 3/1986 | Winther | 156/274.4 |

*Primary Examiner*—Michael W. Ball
*Assistant Examiner*—Richard Crispino
*Attorney, Agent, or Firm*—Flehr, Hohbach, Test, Albritton & Herbert

[57] ABSTRACT

Waterbed mattress having a baffle structure comprising a buoyant foam pad adapted to float within the mattress, and a plurality of hexagonal cells beneath the buoyant pad. The cells are arranged in a honeycomb array with the side walls of adjacent ones of the cells facing each other in a closely spaced parallel relationship. In some embodiments, the bottom portions of the cells are attached to a continuous lower sheet which serves as a lower baffle, and in others the cells have independent bottom walls. The structure with the upper and lower baffles is manufactured by feeding sheets of foam and flexible material past a row of heat sealing dies having spaced apart sealing surfaces movable between open and closed positions. Tubular lengths of flexible material are inserted into the dies with end portions of the tubular lengths being wrapped over the sealing surfaces. The sheets of foam and flexible material are fed on opposite sides of the dies, and the dies are actuated to bond the end portions of the tubular lengths to the sheets and thereby form a row of cells. Thereafter, the dies are opened and the sheets are advanced to bring another portion of the sheets into alignment with the dies so that another row of cells can be formed. The dies are shifted laterally of the sheets between successive rows so that the cells will be arranged in a honeycomb pattern.

9 Claims, 4 Drawing Sheets

METHOD AND APPARATUS FOR MANUFACTURING A WATERBED BAFFLE STRUCTURE

This is a division of Ser. No. 07/660,604, filed Feb. 22, 1991 now U.S. Pat. No. 5,172,437 which is a continuation-in-part of Ser. No. 07/395,714, filed Aug. 18, 1989, now U.S. Pat. No. 5,068,934.

This invention pertains generally to waterbeds and, more particularly, to a waterbed mattress having a baffle structure for reducing wave motion in the water within the mattress, and to a method and apparatus for manufacturing the baffle structure.

Since waterbeds became popular about 20 years ago, a number of different baffle structures have been provided in an effort to eliminate, or at least reduce, the wave motion which some people find disturbing. Early efforts involved the use of vertically extending baffles which were connected to the upper wall of the mattress and produced an undesirable pulling or tensioning of the sleeping surface. More recently, mattresses with horizontally extending baffles which are free of connection to the top wall have been provided. Examples of such mattresses where the baffles are connected to the bottom and side walls are found in U.S. Pat. Nos. 4,247,962 and 4,345,348.

U.S. Pat. No. 4,204,289 describes a waterbed mattress having cylindrical damper baffles affixed to the bottom wall of the mattress for reducing wave action in the water, and U.S. Pat. Nos. 4,577,356 and 4,750,959 describe mattresses having hemispherical baffle chambers suspended from the under side of a horizontally extending baffle.

Another problem with the baffled mattresses heretofore provided is that they have not been totally effective in eliminating wave action. With straight or curved baffles, the wave patterns tend to be transmitted across the surfaces of the baffles rather than being broken up by the baffles.

It is in general an object of the invention to provide a new and improved waterbed mattress having a baffle structure for reducing wave motion within the mattress.

Another object of the invention is to provide a mattress of the above character which overcomes the limitations and disadvantages of baffled mattresses heretofore provided.

Another object of the invention is to provide a new and improved method and apparatus for manufacturing the baffle structure.

These and other objects are achieved in accordance with the invention by providing a waterbed mattress having a baffle structure comprising a buoyant pad of foam adapted to float within the mattress, and a plurality of hexagonal cells depending from the buoyant pad. The cells are arranged in a honeycomb array with the side walls of adjacent ones of the cells facing each other in a closely spaced parallel relationship. In some embodiments, the each cell has a separate bottom wall, and there is no connection between the bottom walls of different cells. In other embodiments, a lower sheet extends coextensively of the buoyant pad and is bonded to the lower portions of the cells to form the bottom walls of the cells and provide a continuous lower baffle.

In a preferred method and apparatus for manufacturing the baffle structure with the continuous lower baffle, sheets of foam and flexible material are fed past a row of heat sealing dies having spaced apart sealing surfaces movable between open and closed positions. Tubular lengths of flexible material are inserted into the dies with end portions of the tubular lengths being wrapped over the sealing surfaces. The sheets of foam and flexible material are fed on opposite sides of the dies, and the dies are actuated to bond the end portions of the tubular lengths to the sheets and thereby form a row of cells. Thereafter, the dies are opened and the sheets are advanced to bring another portion of the sheets into alignment with the dies so that another row of cells can be formed. The dies can be shifted laterally of the sheets so that the cells in successive rows will be offset laterally of each other, e.g. in a honeycomb pattern.

FIG. 1 is an isometric view, partly broken away, of one embodiment of a waterbed mattress incorporating the invention.

FIG. 2 a cross-sectional view of one of the cells in the baffle structure in the embodiment of FIG. 1.

Figure 1:
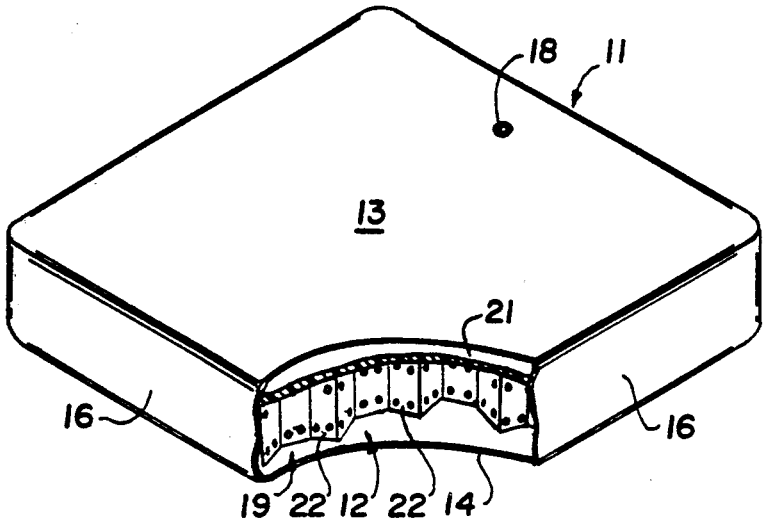
Figure 2:
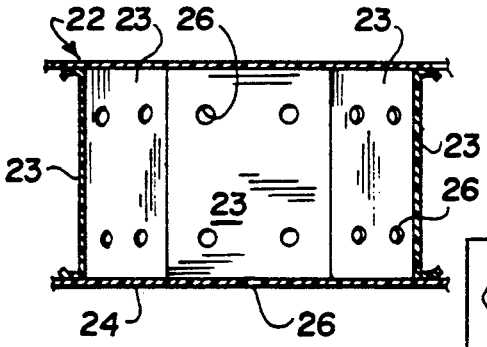

As illustrated in FIG. 1, the mattress comprises a generally rectangular enclosing structure 11 and a body of water 12 which is contained within the enclosure. The enclosure can be fabricated of any suitable flexible material such as vinyl and includes a top wall 13, a bottom wall 14 and side walls 16. The top wall is adapted for receiving persons in sitting and reclining positions and is sometimes referred to as the sleeping surface of the mattress. A valve 18 is provided in the top wall for introducing water into and removing water from the mattress.

A baffle structure 19 is disposed within the enclosure to reduce the wavelike motion of the water within the mattress. This structure includes a horizontally extending pad 21 of buoyant material which floats in the water below the top wall 13 of the enclosure. In one presently preferred embodiment, the pad has a thickness on the order of ¼ inch and a horizontal area corresponding to the sleeping surface of the mattress. Thus, for example, in a king size mattress measuring 84 by 72 inches, the pad has a length of 84 inches and a width of 72 inches. In other embodiments, the pad may range in thickness from about 1/16 inch to about 1 inch.

A plurality of hexagonal cells 22 depend from the under side of pad 21. Each of these cells has six side walls 23 and a hexagonal bottom wall 24. The upper margins of the side walls of each cell are sealed to the pad along a hexagonal path, and the lower margins of the side walls are sealed to the marginal edge portions of the bottom wall to form a closed chamber. Openings 26 are provided in the side and bottom walls permit a limited flow of water into and out of the cells. In one presently preferred embodiment, each of the cells has height on the order of 7½ inches, a corner-to-corner (major) diameter of 11¾ inches, a side-to-side (minor) diameter of 10⅛ inches, and a side wall width of 5⅞ inches, with openings 26 having a diameter on the order of ½ inch.

The six side walls in each cell are formed by a strip of flexible material which extends circumferentially of the cell, with the ends of the strip being sealed together on one side of the cell. Alternatively, the side walls can be formed from a length of tubing, and if the tubing is extruded, no seams are required in the side walls.

Figure 3:
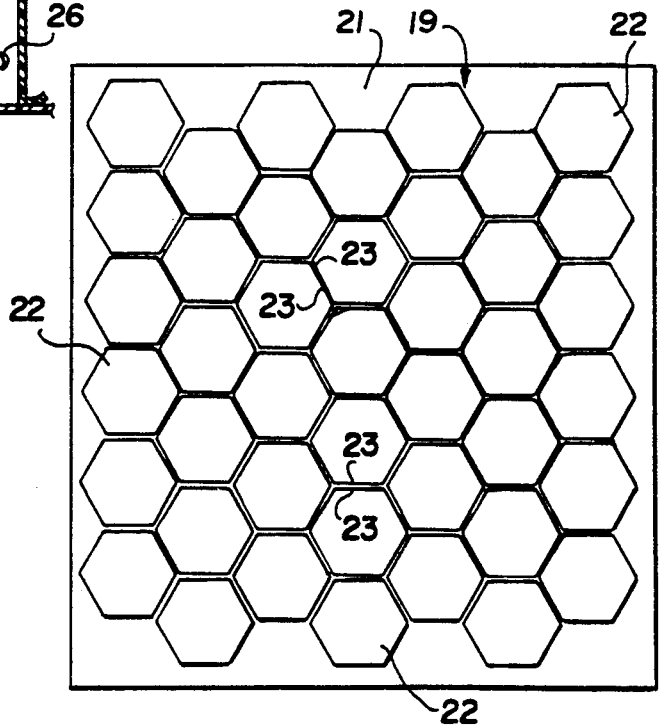
FIG. 3 is a diagrammatic view illustrating the arrangement of the cells in the embodiment of FIG. 1.

As best seen in FIG. 3, the cells 22 are arranged in a honeycomb array, with the side walls of adjacent ones of the cells facing each other in closely spaced parallel relationship. With cells having the dimensions given in the example above, the facing walls of the adjacent cells are separated by a distance on the order of ½ inch. The embodiment illustrated in FIG. 3 has a total of 49 cells arranged in seven rows of seven cells each. The rows extend lengthwise of the mattress, with alternate ones of the rows being offset from the others by a distance equal to one-half of the minor diameter of the cells plus one-half of the distance between the side walls of the adjacent cells. The 49 cell array is intended for use in a king size mattress. Similar arrays having a smaller number of cells can be utilized in other sizes of mattresses. Thus, for example, an array for a super single size mattress might have five rows of seven cells, and an array for a queen size mattress might have six rows of seven cells.

The hexagonal cells and honeycomb array have been found to provide a surprising improvement in the reduction of wave action in comparison with mattresses having rounded or hemispherical baffle chambers. This is believed to be due to the fact that the hexagonally arranged surfaces break up the wave patterns which tend to travel across straight or curved baffle surfaces.

The baffle structure is preferably fabricated of polypropylene, polyethylene or another polymeric material, with pad 21 being fabricated of a buoyant foam and cell walls 23, 24 being fabricated of a film or sheeting, and the seams between the pad, the side walls and the bottom walls of the cells being made by heat sealing. The film used for the bottom walls preferably has a density greater than that of water so the cells hang from the pad in the water with the side walls in an extended condition. If desired, the side wall can also be fabricated of a material having a density greater than that of water. A suitable high density film having a specific gravity or density greater than that of water can be formed by adding a filler material such as carbon to the polymeric material during the manufacture of the film.

Figure 4:
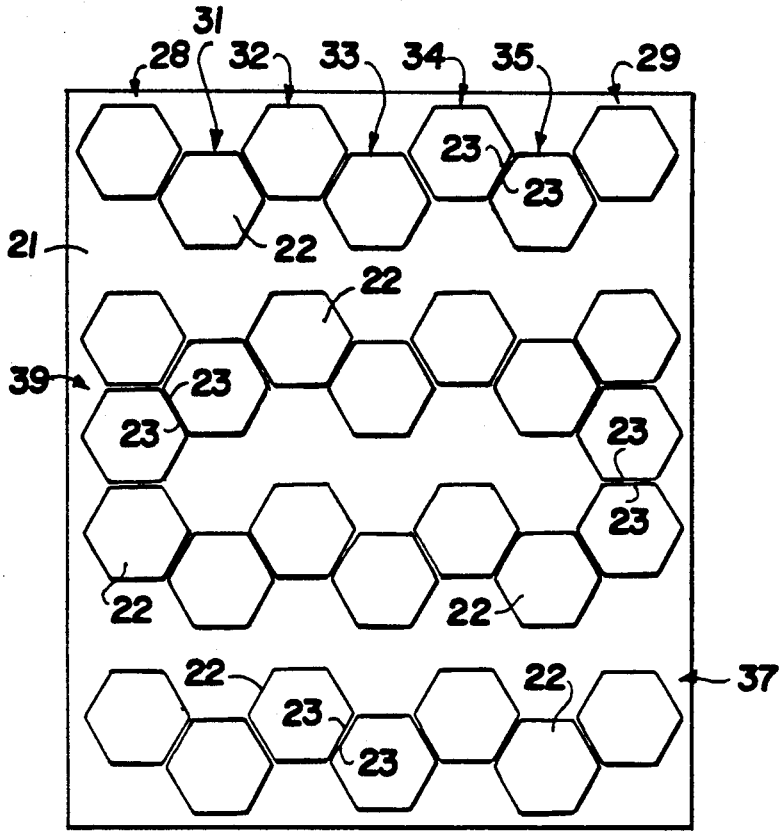
FIG. 4 is a diagrammatic view of another arrangement of cells which can be utilized in the embodiment of FIG. 1.
Figure 6:
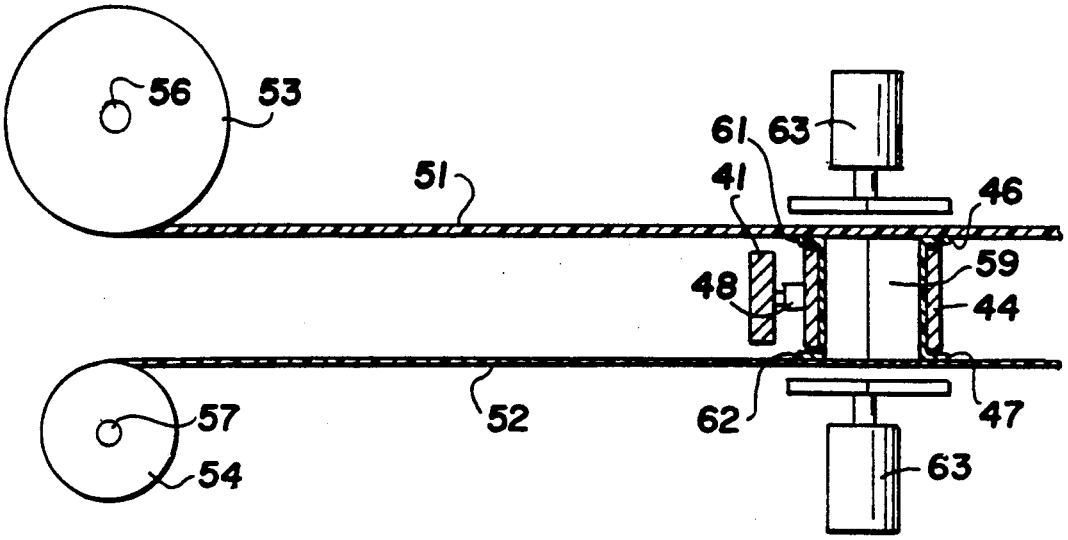
FIG. 6 is a cross-sectional view taken along line 5—5 of FIG. 5.

FIG. 4 illustrates an array of 30 cells for use in a king size bed. This array includes two outer rows 28, 29 of five cells each and five inner rows 31–35 of four cells each. Each of the rows has four cells spaced one cell apart, and the two outer rows each have an additional cell which is closely spaced between the other two inner cells in the row. As in the embodiment of FIG. 3, alternate ones of the rows are offset, and this results in a pattern in which the outer cells form closely spaced groups 37, 38 which extend across the head and foot of the mattress and the inner cells form a generally rectangular, open grouping 39 which extends across the central portion of the mattress. This array is similar to the honeycomb array of FIG. 3 with some of the cells omitted.

An array of cells similar to that shown in FIG. 4 can also be employed in mattresses of different sizes. A super single mattress, for example can have four rows of cells arranged in this configuration, and queen size mattress can have five rows.

Instead of being formed as individual pieces, the bottom walls of the cells can be formed from a continuous sheet which serves as a lower baffle. A continuous sheet has certain advantages in providing a somewhat greater wave dampening action than cells with unconnected bottom walls, but it also presents certain problems from the standpoint of manufacture, particularly with respect to the removal of dies used for sealing the side walls of the cells to the upper and lower sheets.

FIGS. 5–9 illustrate one embodiment of a presently preferred apparatus for manufacturing a baffle structure having a plurality of hexagonal cells arranged in a honeycomb array between an upper sheet of a buoyant foam material and a lower sheet of pliant film material. This apparatus includes a plurality of sealing dies 41 mounted on a frame 42 and arranged in a horizontally extending row. Each of the dies comprises a hexagonal cylinder which is formed in two sections 43, 44 connected together by a vertically extending hinge 45 for movement between open and closed positions. The hinge extends along the longitudinal centerline of one face of the hexagonal cylinder, and each of the two sections comprises one half of the cylinder. The hinged side of each die is closest to the frame, and the sides which open face away from the frame. When the dies are closed, the hinged sides and the sides which open lie in planes which are generally parallel to the frame. Oppositely facing sealing surfaces 46, 47 are formed at the ends of the cylinders, and when the dies are in the closed position, the sealing surfaces extend along hexagonal paths. Pneumatic operators 48 are connected between the die sections and the frame for moving the dies between the open and closed positions, and the frame can be shifted laterally, i.e. in a direction parallel to the row of dies, to offset the cells in successive rows to form the honeycomb array.

Elongated sheets of foam material 51 and film material 52 are fed in spaced parallel relation past the dies in a direction generally perpendicular to the row of dies, with the two sheets passing on opposite sides of the dies. The materials are fed from rolls 53, 54 having horizontally extending axes 56, 57 which are generally parallel to the row of dies. The foam and film materials can be any such materials which are suitable for use in a waterbed mattress, such as polyethylene, polypropylene or another suitable polymer. The density of the foam is preferably sufficiently less than that of water to make the entire baffle structure buoyant in water, and the film typically has a thickness on the order of 0.020 inch. The sheet materials are fed past the dies from the frame side toward the side which opens.

Tubular lengths 59 of a flexible material which can be similar to film material 52 are placed in the dies, with the end portions 61, 62 of the tubular lengths being wrapped over the sealing surfaces of the dies.

Means such as electric heating elements (not shown) is provided for heating the sealing surfaces of the dies, and hydraulic presses 63 are positioned in alignment with the sealing surfaces for pressing the end portions of the tubular lengths and the sheets together against the heated dies to bond these elements together to form the cells.

Operation and use of the apparatus, and therein the method of manufacturing the baffle structure, are as follows. The foam material and the film material are fed past the dies in spaced parallel relation on opposite sides of the dies, and tubular lengths are placed in the dies, with the end portions of the tubular lengths being wrapped over the sealing surfaces at the ends of the dies. When the sheets reach the position where a row of cell is to be formed, the movement of the sheets is stopped, and the dies and presses are actuated to bond the tubular lengths to the sheets along hexagonally extending paths to give the cells the desired hexagonal configuration.

After the cells are formed, the dies are opened and the sheets are advanced to the position where the next row of cells is to be formed, with the previously formed row of cells being free to move out of the dies through the open sides thereof. When these cells are out of the dies, the dies are closed, and new lengths of tubular material are inserted into the dies and wrapped over the sealing surfaces for the next row of cells. As the sheets advance into position for the formation of successive rows, the dies are shifted laterally of the sheets so that the cells in successive rows are offset to form the honeycomb array.

Figure 5:
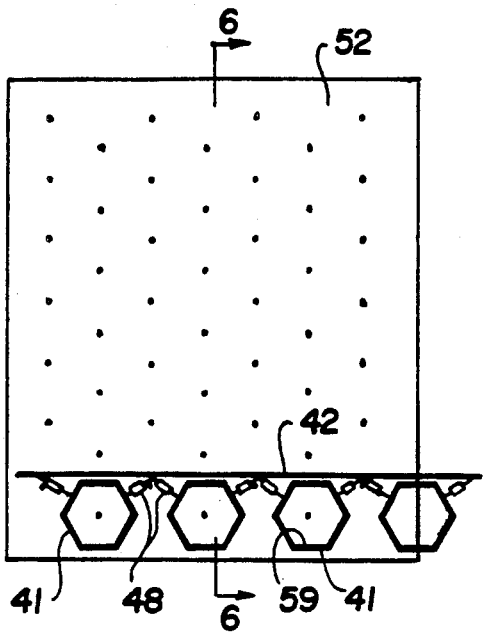
FIG. 5 is a top plan view, somewhat schematic, of one embodiment of apparatus for manufacturing a baffle structure in accordance with the invention.
Figure 7:
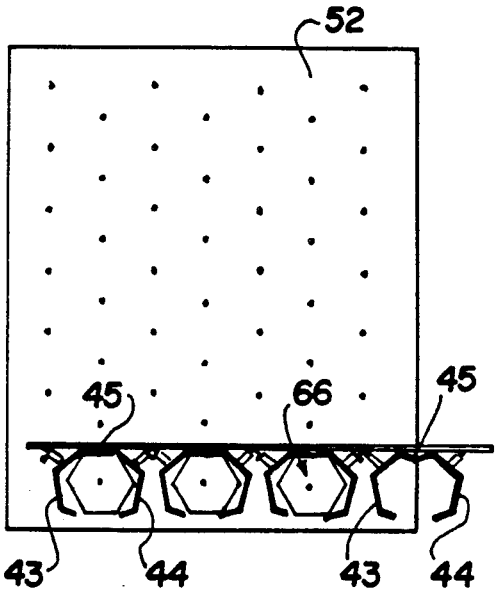
FIGS. 7–9 are operational views illustrating the operation of the apparatus in the embodiment of FIG. 5.
Figure 8:
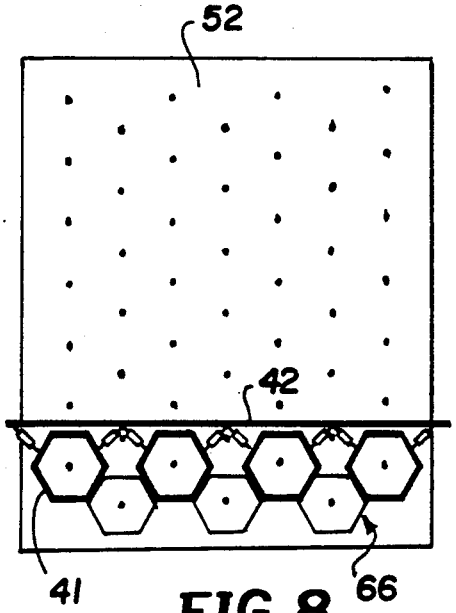
Figure 9:
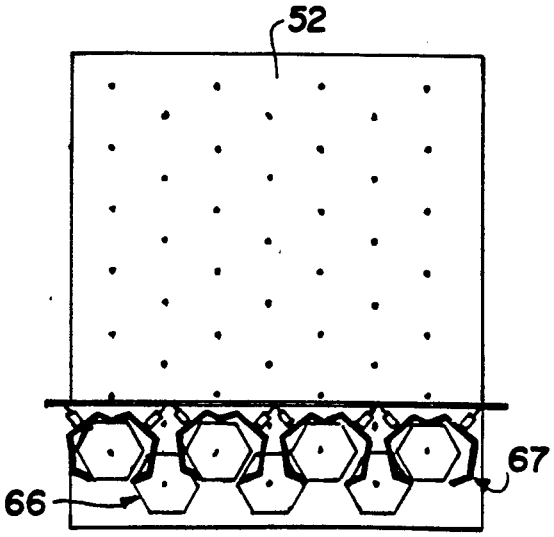

In FIG. 5, the dies are shown in the closed position for forming a first row of cells. FIG. 7 shows the dies in the open position after the first row of cells 66 has been formed. FIG. 8 shows the dies shifted laterally to the left and in the closed position for forming a second row of cells in the honeycomb array. FIG. 9 shows the dies in the open position after the second row of cells 67 has been formed. Thereafter, the dies shift back to the right in position to form the next row of cells in alignment with the first row.

The process continues until as many rows of cells as desired have been formed. In one presently preferred process, cells are formed along the entire length of the sheets of material, and the baffle structure thus produced is rolled up for transportation and/or storage and thereafter cut into lengths as desired for individual mattresses.

Figure 10:
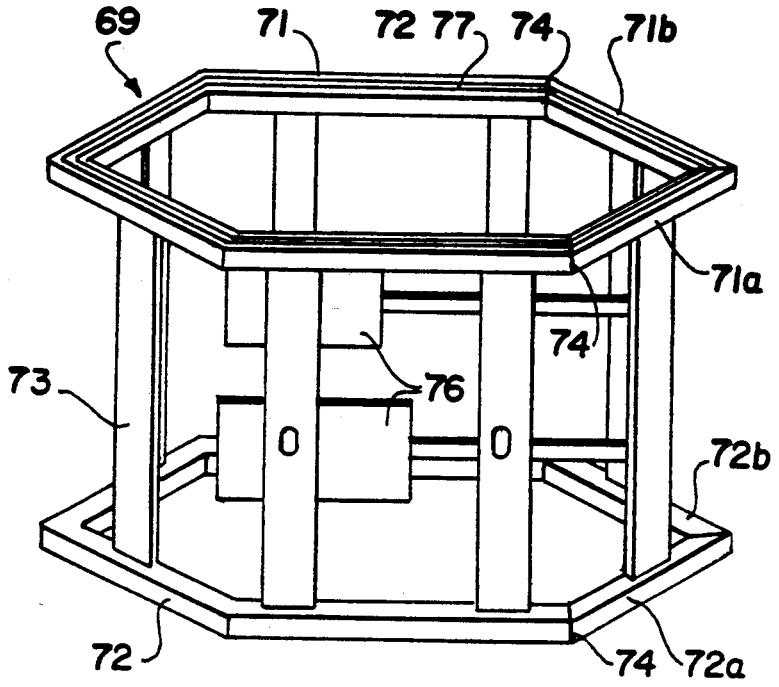
FIG. 10 is an isometric view of one embodiment of a sealing die for making hexagonal baffle cells in accordance with the invention.

In the embodiment of FIG. 10, the sealing die 69 is constructed in the form of an open framework with upper and lower sealing elements 71, 72 connected together by vertically extending struts 73. Each of the sealing elements has six legs or sections arranged in a hexagonal pattern, with two adjacent sections 71*a*/72*a*, 71*b*/72*b* being connected to the others by hinges 74 for movement between open and closed positions. Pneumatic operators 76 are connected to the struts in the movable sections for moving these sections between the open and closed positions to open and close the die. Electrical resistance heating elements 77 are mounted on the upper and lower surfaces of sealing elements 71, 72, respectively.

Figure 11:
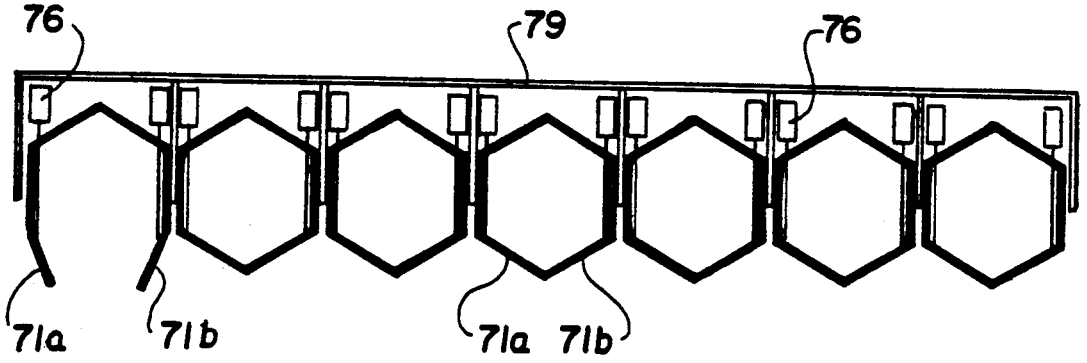
FIG. 11 is a top plan view, somewhat schematic, of one embodiment of apparatus for manufacturing a baffle structure in accordance with the invention with sealing dies of the type shown in FIG. 10, with one of the dies being shown in an open position.

In the embodiment illustrated in FIG. 11, a plurality of the sealing dies 69 are mounted on a frame 79 and arranged in a row extending in a direction generally perpendicular to the direction in which the sheets of foam and film material which form the upper and lower baffles are fed. In this embodiment, the dies are oriented with one corner of each die facing the frame and adjacent sides of adjacent dies parallel to each other, movable sides of the dies opposite the frame. With the dies in their open position, the movable sections 71*a*, 71*b* and 72*a*, 72*b* extend almost in a straight line with the sections to which they are hinged. With this arrangement, the cells can be positioned closer together across the sheets, which means that more cells can be formed across the sheets. This reduces the number of rows which must be formed along the sheets for the honeycomb pattern, and this reduces the time for manufacture. Also, the dies open substantially the entire width of the cells, which facilitates separation of the cells from the dies.

Operation and use of the embodiment of FIGS. 10–11 is similar to that of the embodiment of FIGS. 5–9, with the frame and dies shifting laterally to offset the cells in successive rows to form the honeycomb pattern.

While the embodiments of FIGS. 5–11 are particularly suited for forming hexagonal cells, they can be used for forming cells of other shapes (e.g., rectangular, circular or triangular) between continuously extending upper and lower sheets or baffles by using dies of the desired configuration. With square dies hinged at corners opposite the frame, for example, an array of closely spaced square cells can be formed.

Baffle structures manufactured in accordance with the invention can be tethered to the mattresses in which they are employed in the manner disclosed in copending applications Ser. No. 07/490,130, filed Mar. 6, 1990, and Ser. No. 07/569,096, or in any other suitable manner.

It is apparent from the foregoing that a new and improved waterbed mattress and baffle structure have been provided, together with a method and apparatus for manufacturing the same. While only certain presently preferred embodiments have been described in detail, as will be apparent to those familiar with the art, certain changes and modifications can be made without departing from the scope of the invention as defined by the following claims.

I claim:

1. In a method of manufacturing a waterbed baffle structure having an array of cells between two sheets of flexible material, the steps of: providing a group of heat sealing dies having spaced apart segmented sealing surfaces movable between open and closed positions, inserting tubular lengths of flexible material into the dies with end portions of the tubular lengths being wrapped over the sealing surfaces with the dies in their closed position, positioning two sheets of flexible material in spaced parallel relationship on opposite sides of the dies with portions of the sheets in alignment with the dies, bonding the end portions of the tubular lengths wrapped over the sealing surfaces to the portions of the sheets aligned therewith to form a first group of cells, moving the dies to their open position to release the tubular lengths for movement with the sheets, and advancing the sheets to bring other portions of the sheets into alignment with the dies.

2. The method of claim 1 wherein the end portions of the tubular lengths are bonded to the sheets along hexagonal paths to form hexagonal cells arranged in rows extending laterally of the sheets, and the dies are shifted laterally of the sheets between the formation of successive rows so that the cells in successive rows are offset from each other in a honeycomb pattern in which the side walls of adjacent ones of the cells face each other in closely spaced parallel relationship.

3. In apparatus for manufacturing a waterbed baffle structure having an array of cells extending between a pair of horizontally extending sheets of flexible material: a row of segmented sealing dies which are movable between open and closed positions and have pairs of oppositely facing sealing surfaces which extend along closed paths when the dies are in their closed position, said dies being adapted to receive tubular lengths of flexible material in circumscribing relationship therein with end portions of the tubular lengths being wrapped over the sealing surfaces when the dies are in their closed position, means for advancing a pair of elongated sheets of flexible material past the dies to successively bring different areas of the sheets into alignment with the dies, means for bonding the end portions of the tubular lengths wrapped over the sealing surfaces to the sheets to form rows of cells between the sheets, and means for moving the dies to their open position after each row of cells is formed to release the tubular lengths from the dies for advancement with the sheets.

4. The apparatus of claim 3 wherein the paths along which the sealing faces of the dies extend are hexagonal, and the apparatus includes means for shifting the dies laterally of the sheets so that the cells in successive rows are offset from each other to form a honeycomb pattern in which the side walls of adjacent ones of the cells face each other in closely spaced parallel relationship.

5. The apparatus of claim 3 including a roll of foam material which is buoyant in water, a roll of film material, and means for feeding the material from the rolls past the dies in spaced parallel relationship to provide the sheets.

6. In apparatus for manufacturing a waterbed baffle structure having an array of cells arranged in a honeycomb pattern with the side walls of adjacent ones of the cells facing each other in closely spaced parallel relationship: means for supporting a roll of buoyant foam material and a roll of flexible material for rotation about generally parallel axes, a group of segmented hexagonal sealing dies movable between open and closed positions about axes perpendicular to the axes of the rolls, each of said dies having a pair of oppositely facing sealing surfaces which extend along hexagonal paths when the dies are in their closed position, said dies being adapted to receive tubular lengths of flexible material in circumscribing relationship therein with end portions of the tubular lengths being wrapped over the sealing surfaces when the dies are in their closed position, means for feeding the foam material and the flexible material in spaced parallel relationship past the dies to successively bring different areas of the two materials into alignment with the dies, means for bonding the end portions of the tubular lengths wrapped over the sealing surfaces to the foam material and to the flexible material to form groups of cells between the foam material and the flexible material, and means for moving the dies to their open position after each group of cells is formed to release the tubular lengths from the dies for advancement with the foam material and the flexible material.

7. The apparatus of claim 6 wherein each of the sealing dies comprises a hexagonal cylinder formed in two sections which are hinged together for movement about an axis parallel to the axis of the cylinder, with the sealing surfaces being formed at the ends of the cylinder.

8. The apparatus of claim 6 wherein the sealing dies are arranged in a row which extends in a direction perpendicular to the direction in which the foam material and the flexible material are fed.

9. The apparatus of claim 8 including means for shifting the row of dies laterally of the foam material and the flexible material so that the cells in successive rows are offset from each other to form the honeycomb pattern.

* * * * *